US011772155B2

(12) United States Patent
Leriche et al.

(10) Patent No.: US 11,772,155 B2
(45) Date of Patent: Oct. 3, 2023

(54) METHOD FOR MANUFACTURING A METAL WORKPIECE LIMITING THE APPEARANCE OF RECRYSTALLIZED GRAINS IN SAID WORKPIECE

(71) Applicant: SAFRAN AIRCRAFT ENGINES, Paris (FR)

(72) Inventors: Nicolas Romain Benjamin Leriche, Moissy-Cramayel (FR); Serge Alain Fargeas, Moissy-Cramayel (FR); Fabien Corpace, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/640,171

(22) PCT Filed: Sep. 4, 2020

(86) PCT No.: PCT/FR2020/051533
§ 371 (c)(1),
(2) Date: Mar. 3, 2022

(87) PCT Pub. No.: WO2021/044105
PCT Pub. Date: Mar. 11, 2021

(65) Prior Publication Data

US 2022/0379371 A1 Dec. 1, 2022

(30) Foreign Application Priority Data

Sep. 4, 2019 (FR) ..... 1909712

(51) Int. Cl.
*B22D 27/20* (2006.01)

(52) U.S. Cl.
CPC ..... *B22D 27/20* (2013.01)

(58) Field of Classification Search
CPC ..... B22D 27/00; B22D 27/04; B22D 27/20
(Continued)

(56) References Cited

U.S. PATENT DOCUMENTS 5,865,911 A * 2/1999 Miyasato et al. ..... C22C 21/10 148/438
2007/0029016 A1* 2/2007 Gheorghe ..... C22C 21/10 148/683
(Continued)

FOREIGN PATENT DOCUMENTS

EP 0 577 316 A2 1/1994
EP 0 577 316 A3 1/1994
(Continued)

OTHER PUBLICATIONS

International Search Report dated Dec. 14, 2020 in International Application No. PCT/FR2020/051533.
(Continued)

*Primary Examiner* — Kevin P Kerns
(74) *Attorney, Agent, or Firm* — Sughrue Mion, PLLC

(57) ABSTRACT

A method for manufacturing a metal workpiece by casting a metal alloy in a mould, in which prior to the casting, a chart is determined providing a risk of appearance of recrystallised grains during the casting and/or solidification of the metal workpiece, depending on temperature and plastic deformation energy conditions undergone by the metal workpiece, the casting of the metal alloy in the mould being implemented under casting and solidification conditions determined using the chart in order for the temperature and plastic deformation energy conditions undergone by the metal workpiece to be less than a given threshold for the risk of appearance of recrystallised grains.

12 Claims, 7 Drawing Sheets

(58) Field of Classification Search
USPC ..... 164/4.1, 47, 122
See application file for complete search history.

(56) References Cited

U.S. PATENT DOCUMENTS

| | | | | |
|---|---|---|---|---|
| 2008/0000557 | A1* | 1/2008 | Ghosh et al. | C22F 1/06 148/420 |
| 2017/0218491 | A1* | 8/2017 | Stewart | C22C 38/34 |

FOREIGN PATENT DOCUMENTS

| | | | |
|---|---|---|---|
| EP | 1 038 983 | A1 | 9/2000 |
| WO | 2018/178915 | A1 | 10/2018 |

OTHER PUBLICATIONS

Written Opinion of the International Searching Authority dated Dec. 14, 2020 in International Application No. PCT/FR2020/051533.
Preliminary Search Report dated Jul. 30, 2020 in French Application No. 1909712.
Panwisawas et al., "Prediction of recrystallization in investment cast single-crystal superalloys", Acta Materialia, 2013, vol. 61, No. 1, pp. 51-66 (16 pages total).
Panwisawas et al., "Prediction of recrystallization in single crystal nickel-based superalloys during investment casting", MATEC Web of Conferences, 2014, vol. 14, pp. 1-6 (6 pages total).

* cited by examiner

A1

METHOD FOR MANUFACTURING A METAL WORKPIECE LIMITING THE APPEARANCE OF RECRYSTALLIZED GRAINS IN SAID WORKPIECE

FIELD OF THE INVENTION

The present invention relates to the manufacture of metal workpieces, in particular in the aeronautical field.

More particularly, the invention relates to the limitation of the appearance of recrystallized grains during the manufacture of such a workpiece.

STATE OF THE ART

In the context of the production of molded turbine workpieces for turbojet engines, use is made of alloys by directed solidification (growth by directed solidification such as the alloy referenced "DS 200" for the production of low pressure engines) and monocrystalline growth (example: high pressure blading of some turbojet engines, complex blades). In this context, such alloys are sensitive to the appearance of recrystallized grains.

These recrystallized grains, unlike solidification grains, are not formed during the raw manufacturing method, but originate from the plastic deformation of the crystalline metal network. The plastic deformation can be generated during the differential shrinkage between the metal workpiece, the shell mold and the ceramic core. It can also appear under the effect of a shock, for example during handling or finishing operations.

The thermal energy supplied to monocrystalline workpieces during thermal treatment (dissolving at 1300° C. for 3 hours for the alloy referenced "AM1" and 1240° C. for 4 hours for the alloy referenced "DS 200") makes the previously formed dislocations free to move, during plastic deformation, and forms grain boundaries (perimeter of recrystallized grains). The structure of the workpieces is therefore no longer monocrystalline, which can lead to a degradation of the mechanical resistance under high temperature conditions.

Software for modeling the casting and solidification of a metal alloy in a mold allows to calculate the stresses and the plastic deformation to which the workpieces are subjected during the cooling of the alloy. From these values, it is possible to calculate the plastic deformation energy values in an entire workpiece.

However, such software does not allow to directly decide on the appearance of recrystallized grains.

The publications "Prediction of recrystallization in investment cast single-crystal superalloys" (C. Panwisawas and al., Acta Materialia 61 (2013) 51-66) and "Prediction recrystallization in single crystal nickel-based superalloys during investment casting" (C. Panwisawas and al., Proceedings of Eurosuperalloys 2014 (2014)) are also known in the prior art. A purpose of the work described in these publications is to establish a recrystallization criterion that can be used in digital simulation and which is then verified by casting test pieces.

This criterion, based on the plastic deformation, is established by traction tests on traction test pieces at different temperatures and at different final plastic deformations. However, the criterion corresponding to the plastic deformation does not allow to precisely describe the physical phenomenon of recrystallization (germination of recrystallized grains on zones of concentration of dislocations).

In addition, the geometry used in the work of C. Panwisawas is very different from that of a turbine workpiece such as a blade, and proves to be insufficient to characterize the risk of appearance of recrystallized grains in a shape of hollow blade.

Thus, with the aim of having mechanical workpieces with very high mechanical performance at high temperature, there is always a need for a solution that allows to control the appearance of recrystallized grains during the manufacture of a metal workpiece.

DISCLOSURE OF THE INVENTION

The object of the present invention is to meet the needs described above.

More specifically, the object of the invention is a method for manufacturing a metal workpiece by casting a metal alloy in a mold, wherein prior to said casting, a chart is determined providing a risk of appearance of recrystallized grains during the casting/solidification of the metal workpiece, depending on temperature and plastic deformation energy conditions undergone by said metal workpiece, said chart being obtained by implementing the following steps:

- mechanical test, for example traction mechanical test, on a test piece so as to characterize a plastic deformation of said test piece according to different values of imposed stresses;
- thermal treatment of said test piece, then macrographic etching to determine the appearance of recrystallized grains in the test piece; and
- calculation, according to the stress values measured during the mechanical test, of the plastic deformation energy in the test piece, the plastic deformation energy being plotted as a function of the temperature during the mechanical test, with information relating to the presence of recrystallized grains, so as to constitute the chart; the casting of the metal alloy in the mold is then carried out in order for the temperature and plastic deformation energy conditions undergone by said metal workpiece to be manufactured to be less than a given threshold for the risk of appearance of determined recrystallized grains according to the chart.

Such a method has the advantage of using the quantity corresponding to the plastic deformation energy, which allows to precisely describe the physical phenomenon of recrystallization. It is thus possible to produce metal workpieces offering very high mechanical performance at high temperature, and particularly adapted for the aeronautical field.

Advantageously, but optionally, the system according to the invention can further comprise at least one of the following features:

- the mechanical test on the test piece is a traction test interrupted before rupture;
- the mechanical test is carried out at an imposed temperature;
- the calculation of the plastic deformation energy is determined from the total plastic deformation undergone by the test piece during the traction test;
- the mechanical test is carried out at an imposed deformation rate and at an imposed cooling rate;
- the calculation of the plastic deformation energy is determined from the total plastic deformation undergone by the test piece during the mechanical test, said total plastic deformation being determined from the elastic deformation, and the thermal expansion, undergone by the test piece during the mechanical test;

the production of a chart includes, after the calculation of the plastic deformation energy, a step of verifying said calculation by digital simulation of the mechanical test including the following sub-steps:

casting test of at least one simplified workpiece having a geometry representative of the geometry of the metal workpiece to be manufactured;

thermal treatment of said simplified workpiece, then macrographic etching to determine the presence of recrystallized grains in the simplified workpiece;

digital simulation of the casting of the simplified workpiece and calculation of the plastic deformation energy in said workpiece during its cooling;

plotting of the calculated values of plastic deformation energy to the chart and validation of the chart if the presence of recrystallized grains in the simplified workpiece is consistent with the risk of appearance of recrystallized grains determined by the chart;

the casting and solidification conditions include the following parameters:

a susceptor setpoint temperature;

a rate of pulling the casting mold from a hot zone to a cold zone of a furnace; and a use of a thermal insulator around the casting mold;

said metal workpiece is a turbine blade, and wherein the simplified workpiece includes a geometry representative of the geometry of the turbine blade;

said metal workpiece is made of an AM1 or DS200 or CMSX-4 alloy;

the thermal treatment step is carried out at a temperature above 1200° C.; and the deformation rate is comprised, in % of deformation, between around $10^{-6}$/s and around $10^{-4}$/s, and/or the cooling rate is comprised between around 10° C./min and around 40° C./min.

DESCRIPTION OF THE FIGURES

Other features, objects and advantages of the invention will emerge from the description which follows, which is purely illustrative and not limiting, and which must be read in conjunction with the appended drawings, wherein.

DETAILED DESCRIPTION OF THE INVENTION

First Embodiment

Figure 1A:
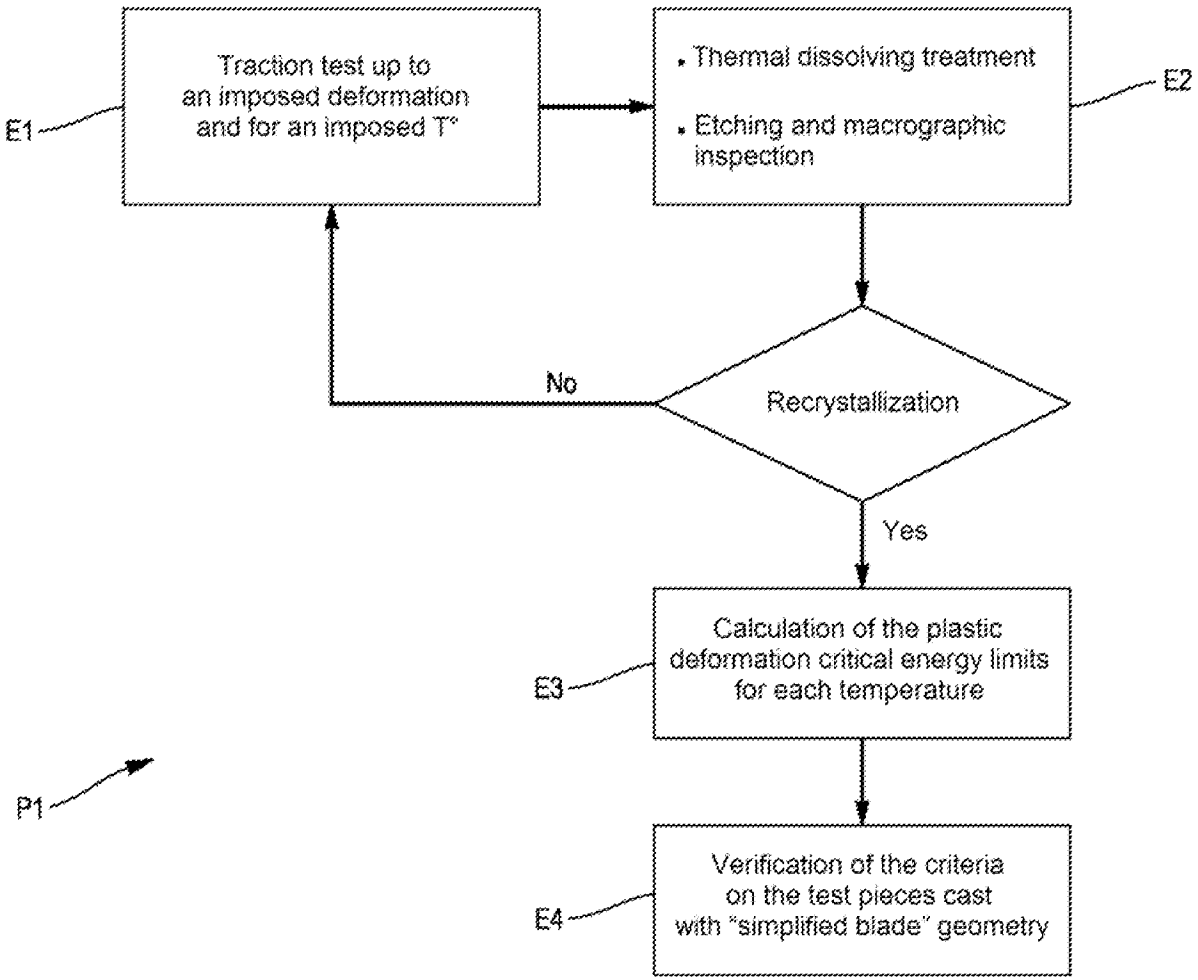
FIG. 1A illustrates the steps of a method for producing a chart for predicting recrystallized grains implemented in a method for manufacturing a metal workpiece according to a first embodiment of the invention.

With reference to FIG. 1A, the main steps of a method P1 for producing a chart for predicting the appearance of recrystallized grains are illustrated, said chart is intended to be implemented in a method for manufacturing a metal workpiece.

The metal workpiece is preferably made from a superalloy. Superalloys are complex alloys of metal materials, essentially based on nickel or cobalt, with good mechanical strength at high temperature (above 500 to 550° C.) and a certain resistance to oxidation or hot corrosion. They are used for the production of industrial or marine gas turbines, aeronautical turbomachines.

Such an alloy is for example of the AM1 type. The AM1 alloy is a nickel-based superalloy advantageously used in the production of aircraft engine turbine blades. It is a monocrystal which has the advantage of being free of fragile zones such as grain boundaries and has a very homogeneous metallurgical structure.

In a step E1 of the method P1, mechanical tests aiming at characterizing the mechanical behavior (in particular elastic behavior) of a test piece, metal workpieces of standardized dimensions, are carried out for different stress values applied to said test piece.

Preferably, the mechanical test is a traction mechanical test, it being understood that other types of stresses are applicable. Also, preferably the test is interrupted before rupture of the test piece called traction test piece in this test context.

Traction tests are carried out for different temperatures and for different values of plastic deformation.

For a given test, it is carried out up to an imposed deformation and for an imposed temperature. The test temperature is ideally the solidus of the alloy.

Preferably, the tests are carried out on a machine usually used for tests for characterizing alloys in fatigue. Advantageously, such a machine allows to carry out the traction tests at temperatures above 1200° C.

In a step E2, subsequent to E1, each traction test piece can then be subjected to a thermal dissolving treatment which allows to generate (or not) recrystallized grains.

Subsequently, each traction test piece can be subjected to macrographic etching, preferably by chemical treatment. A macrographic inspection subsequently allows to visualize the presence of recrystallized grains in a given metal test piece.

Thus, after thermal treatment and macrographic etching, it is determined whether the conditions of temperature (thermal treatment) and of a criterion related to plastic deformation have generated (or not) recrystallized grains. Indeed, as described previously, the criterion corresponding directly to the plastic deformation does not allow to precisely describe the physical phenomenon of recrystallization.

The difference in thermal contraction between the shell mold and the metal, due to the difference in the coefficients of thermal expansion, leads to stressing the metal in the solidification and during cooling. When stress and deformation exceed the elastic limit of the alloy, it is likely to recrystallize during thermal activation. Advantageously, the variable that best represents the recrystallized grain is the plastic deformation energy because it takes into account the stress and the plastic deformation rate.

Thus, the demonstration of this appearance of recrystallized grains on the traction test pieces, associated with the plastic deformation energy criterion, allows the establishment of a chart in a step E3 described below.

Figure 3A:
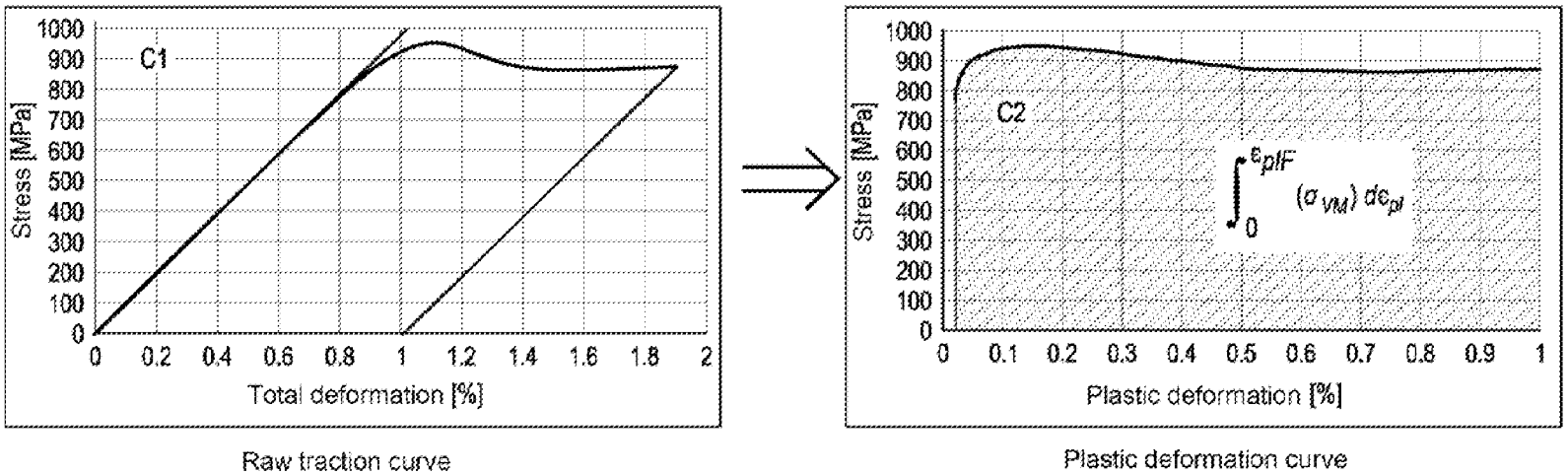
FIG. 3A illustrates traction test curves implemented in a method for producing a chart for predicting recrystallized grains according to the first embodiment of the invention.

With reference to FIG. 3A, for each traction test piece at the end of the traction test, raw traction curves C1 are obtained. Thus, for each test piece, the traction machine is used to establish the traction curve (with on the abscissa: traction stress and on the ordinate: total deformation).

From curve C1, it is then possible to deduce the final plastic deformation energy on the test piece. In this way, for each curve C1, a curve C2 is deduced which represents the plastic deformation (in %) for a given test.

Then, for $$\varepsilon_{p_{ij}} \quad \text{[Math. 1]}$$

corresponding to the components of the plastic deformation tensor, $$\varepsilon_{p_{ij}}^{f} \quad \text{[Math. 2]}$$

corresponding to the final values of the components of the plastic deformation tensor, $$\sigma_{ij} \quad \text{[Math. 3]}$$

corresponding to the components of the tensor of the stresses undergone by the material, the raw traction curve C1 allows the calculation of the plastic deformation energy corresponding to the area of the plastic range C2 by applying the following formula:

$$E_{pl} = \sum_{i,j} \int_0^{\varepsilon_{p_{ij}}^{f}} \sigma_{ij} \cdot d\varepsilon_{p_{ij}} \quad \text{[Math .4]}$$

Alternatively, for $$\varepsilon_{pl} \quad \text{[Math. 5]}$$

corresponding to the plastic deformation, $$\varepsilon_{plF} \quad \text{[Math. 6]}$$

corresponding to the final plastic deformation value, $$\sigma_{VM} \quad \text{[Math. 7]}$$

corresponding to the von Mises equivalent stress applied to the material, the raw traction curve C1 allows the calculation of the plastic deformation energy corresponding to the area of the plastic range C2 by applying the following formula:

$$\int_0^{\varepsilon_{plF}} (\sigma_{VM}) d\varepsilon_{pl} \quad \text{[Math. 8]}$$

Advantageously, the use of this formula allows to reduce the calculation load, because the general form $$\sum_{i,j} \int_0^{\varepsilon_{p_{ij}}^{f}} \sigma_{ij} \cdot d\varepsilon_{p_{ij}} \quad \text{[Math. 9]}$$

requires the calculation of 6 integrals and their sum (there are 6 independent components in the tensors) while the calculation of $$\int_0^{\varepsilon_{plF}} (\sigma_{VM}) d\varepsilon_{pl} \quad \text{[Math. 10]}$$

requires the calculation of a single integral.

It should be noted that in the particular case of the traction tests since there is only one component of the imposed stresses and deformations, these two expressions are strictly equal.

The exploitation of curves C1 and C2, related to the determination of the presence of recrystallized grains in a given metal test piece, allows to calculate the plastic deformation energy beyond which the alloy recrystallizes, thus allowing to establish a chart.

Figure 4A:
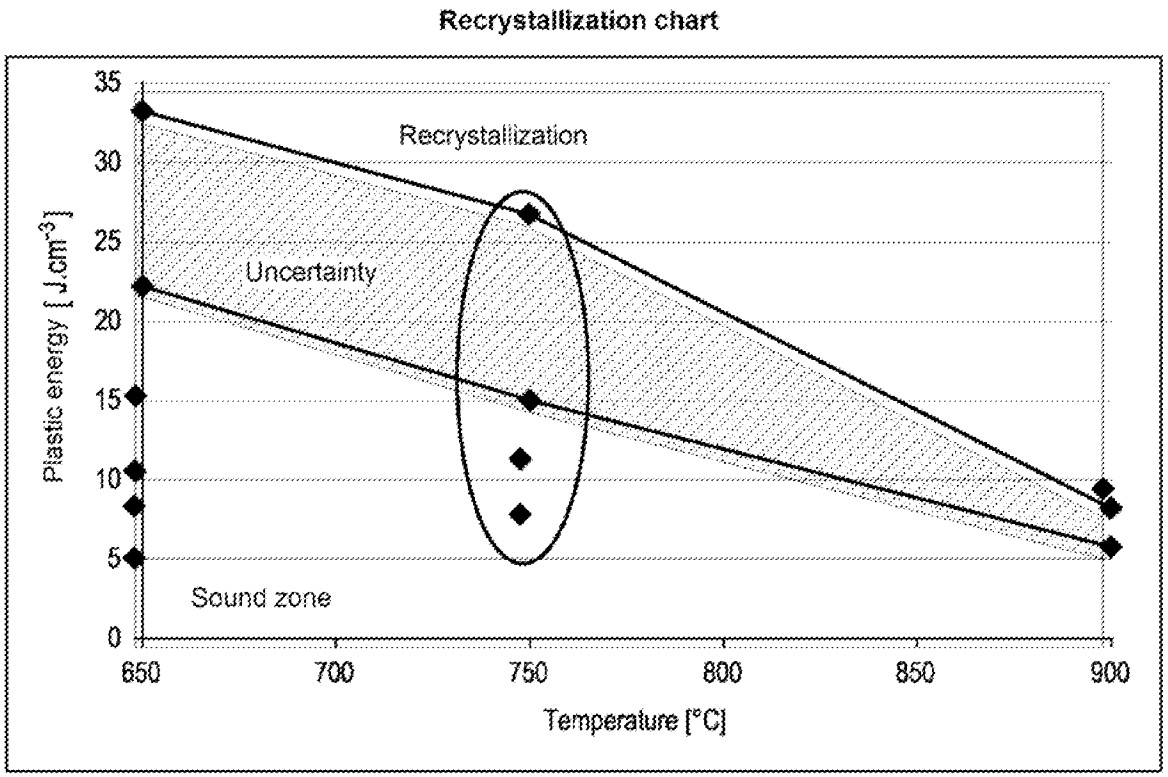
FIG. 4A illustrates a recrystallized grain prediction chart obtained according to the first embodiment of the invention.

With reference to FIG. 4A, such a chart A1 is shown. The latter allows to determine plastic energy threshold values for the appearance of recrystallized grains.

The chart can consist of three zones, the range extent of which depends on the temperature of the test.

A chart of the plastic deformation energy as a function of temperature allows to specify the recrystallization range and therefore to establish a level of risk of appearance of recrystallized grains.

Each point represents a traction test. The points in the sound zone correspond to the sound test pieces, and the points in the recrystallization zone correspond to the test pieces having recrystallized grains. If the chart includes 3 zones, depending on the temperature and plastic deformation energy, a first zone can thus indicate a probable risk of crystallization, a second zone can indicate an unlikely risk (zone called sound zone), and a third zone can indicate an uncertain risk. The establishment of a chart thus allows to predict recrystallization by determining threshold values of plastic energy for the appearance of recrystallized grains rather than the plastic deformation only.

Subsequently in a step E4, a step of validating the chart previously determined can be carried out, by tests of casting simplified workpieces having a geometry significant of the geometry of the metal workpiece to be manufactured.

Advantageously, a geometry of simplified workpieces is determined beforehand to best characterize the risk of appearance of recrystallized grains.

Thus, for the blading made of an alloy, for example, of the AM1 or DS 200 or CMSX-4 type, a simplified workpiece shape is determined representative of a real (movable or distributor) blading shape, such a workpiece is called "simplified blade". These "simplified blades" can undergo, just like the traction test pieces mentioned above, the same thermal treatment and chemical etching in order to reveal the recrystallization.

Figure 2:
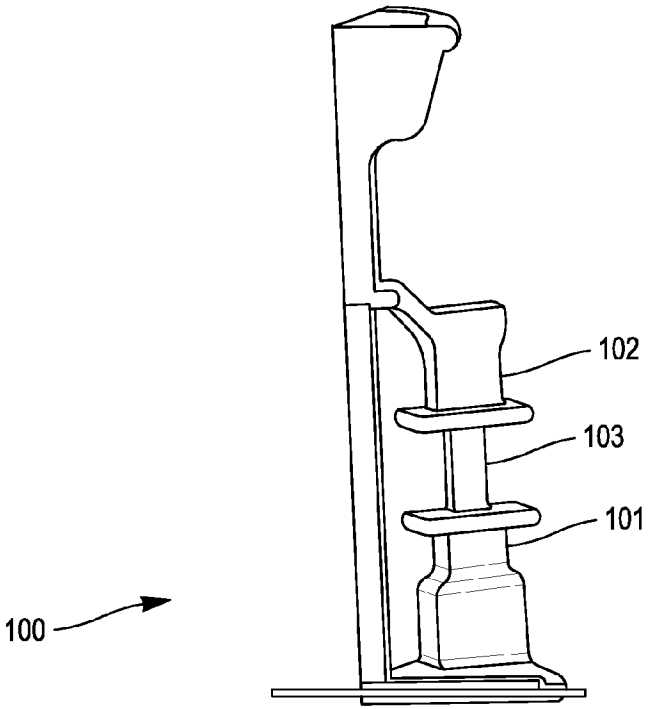
FIG. 2 schematically illustrates a turbine blade test piece implemented in a method for producing a chart for predicting recrystallized grains according to the invention.

With reference to FIG. 2, such a simplified blade geometry 100 is illustrated. In order to better characterize the risk of recrystallization in the zone of the vane 103 on movable blades, a shape is defined having an internal platform 101 and an outer platform or heel 102 in the vicinity of the free end of the vane. The test piece 100 also has an equally rectangular section 103 representing a vane of variable thickness and width. The vane 103 extends in the longitudinal direction between the platform 101 and the heel 102 and has in cross section a curved profile of variable thickness between its leading edge and its trailing edge.

Preferably, the simplified blade includes a width between about 5 and 20 mm. Also, the simplified blade includes a thickness of about 1 or about 1.5 mm.

The casting tests, the determination of the casting/solidification parameters of the simplified workpiece are also carried out beforehand, allowing to better characterize the risk of recrystallized grains appearing in the simplified workpiece. Casting and solidification parameters are for example:

- the susceptor setpoint temperature (conductive material, for example metal or graphite, used to transfer heat by radiation to another metal workpiece or to another non-conductive material);
- the rate of pulling the shell mold from the hot zone to the cold zone of the metal alloy melting furnace;
- the use (or not) of a thermal insulator around the casting mold, indeed this criterion is important in the sense that the stresses which cause recrystallization in the workpieces depend on the thermal gradients and the shape of the solidification front during the implementation in the furnace. Insulators are a means for controlling these gradients and this front; and
- the thickness of the shell mold.

For a fixed geometry of simplified workpieces, different castings of simplified workpieces can therefore be carried out, wherein the casting/solidification parameters may vary.

The simplified workpieces then undergo a thermal treatment, then a macrographic etching, like traction test pieces, to observe the appearance (or absence) of recrystallized grains in said workpieces.

The plastic deformation energy is also calculated in the simplified workpieces during their cooling, by digital simulation of the casting of these workpieces (because it is inaccessible experimentally) to determine the plastic energy values reached in different zones of the workpiece during cooling. The influence of each casting/solidification parameter on the recrystallization being determined beforehand, it is therefore possible to corroborate the influence of the plastic energy values reached in the different zones of the workpiece during cooling with the presence of the recrystallization phenomenon in said zones of the workpiece.

The plastic energy values obtained by simulations are thus plotted on the chart and by comparison with the observation of recrystallized grains obtained with the simplified workpieces, the plastic energy threshold values of the chart beyond which the alloy recrystallizes can be validated and/or refined.

Thus, after establishing a chart on the critical plastic energy (beyond which the alloy recrystallizes) as a function of the temperature, it is possible to verify quantitatively that the criterion is valid by coupling the casting of a plurality of simplified workpieces and the digital simulation of the casting of these simplified workpieces.

A digital simulation software used in this context is for example the ProCast software (developed by ESI Group).

Second Embodiment

Figure 1B:
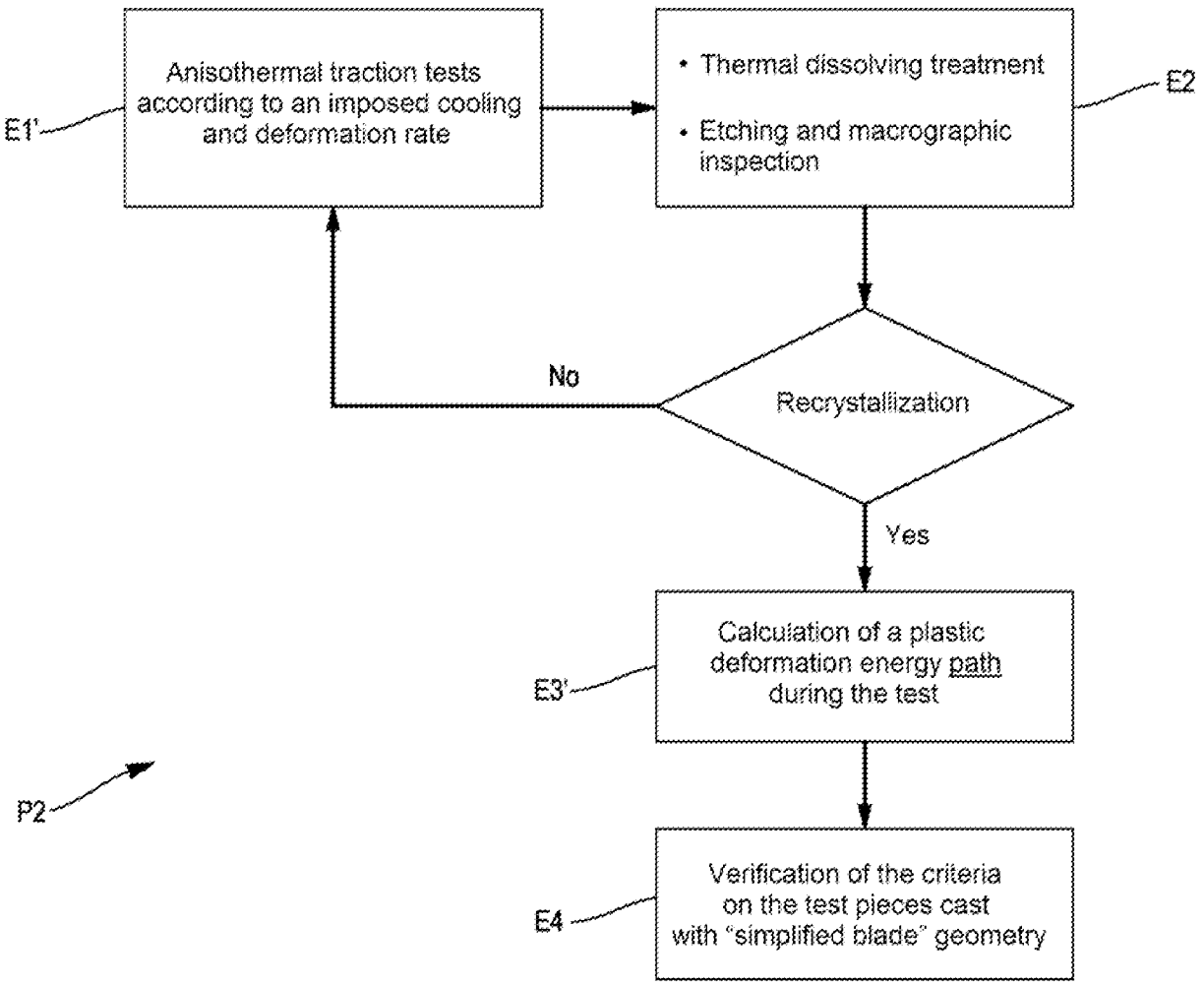
FIG. 1B illustrates the steps of a method for producing a chart for predicting recrystallized grains implemented in a method for manufacturing a metal workpiece according to a second embodiment of the invention.

With reference to FIG. 1B, a second embodiment P2 of the method according to the invention implementing mechanical tests, preferably traction mechanical tests, is illustrated.

Unlike the first embodiment P1, the method according to P2 comprises for each alloy in a step E1' anisothermal traction tests, preferably interrupted (before rupture), for different cooling rates and different plastic deformation rates.

The thermomechanical paths chosen for the tests (cooling rate/deformation rate pair) are established experimentally or by simulation to be as representative as possible of the actual casting method.

As in the first embodiment P1, the test temperature is ideally the solidus of the alloy, preferably above 1200° C.

The tests were therefore carried out on a machine usually used for fatigue characterization tests on alloys.

Advantageously, the fact that the tests begin at 1200° C. is taken into account in the paths chosen because this temperature is less than the temperature at which metal deformation begins in a real casting.

Then, as in the first embodiment P1, in a step E2, each traction test piece is subjected to a thermal dissolving treatment which allows to generate (or not) recrystallized grains.

Then, a macrographic etching and inspection allows to visualize the presence of recrystallized grains.

After thermal treatment and macrographic etching, it is known whether the temperature and plastic deformation conditions have generated (or not) recrystallized grains. The demonstration of this appearance of recrystallized grains will lead to the establishment of a chart in a step E3'.

Figure 3B:
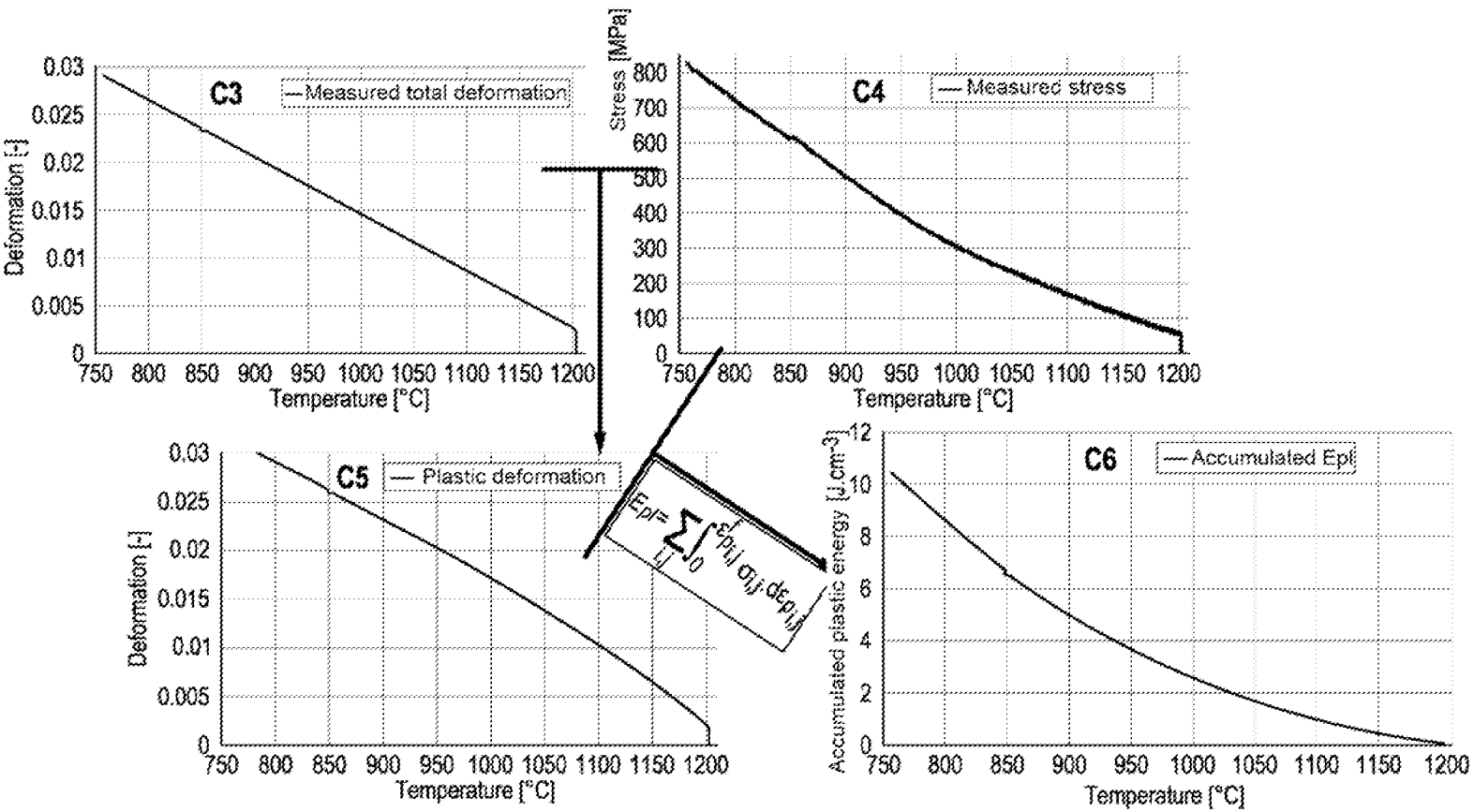
FIG. 3B illustrates traction test curves implemented in a method for producing a chart for predicting recrystallized grains according to the second embodiment of the invention.

With reference to FIG. 3B, for each test piece, the traction machine provides the traction curve C4 (abscissa: traction stress and ordinate: total deformation).

Each test piece then represents a curve on the chart:

- on the abscissa: the temperature during the test
- on the ordinate: the plastic deformation energy accumulated during the test With reference to FIG. 3B, the calculation of the plastic deformation part is also illustrated $$\varepsilon_{pl} \quad \text{[Math. 11]}$$

of this total deformation (C3).

Unlike the 1$^{st}$ embodiment, the calculation of $$\varepsilon_{pl} \quad \text{[Math. 12]}$$

takes into account:

- The part of the thermal contraction of the traction test piece (which is not taken into account by the traction machine).
- The fact that the mechanical properties of the alloy (and therefore of the test piece) are modified during the test because they depend on the temperature. This concerns in particular the elastic limit and the modulus of elasticity.

With reference to FIG. 3B for each test piece at the end of the anisothermal traction test, the total deformation of said test piece is measured according to the temperature, as illustrated by curve C3.

The stress applied to the test piece is also measured as a function of temperature, as illustrated by curve C4.

Knowing that the total deformation is equal to the addition of the elastic deformation, the thermal expansion, and the plastic deformation $$(\varepsilon_{tot}=\varepsilon_{el}+\varepsilon_{th}+\varepsilon_{pl}). \quad \text{[Math. 13]}$$

From the total deformation curve C3, the plastic deformation C5 is extracted by the equation ( $$\varepsilon_{tot}=\varepsilon_{el}+\varepsilon_{th}+\varepsilon_{pl} \quad \text{[Math. 14]}$$

) and knowing the stress curve C4.

The expression of the thermal deformation of the traction test piece during anisothermal tests is also given by the following formula:

$$\varepsilon_{th} = \frac{\alpha_{T_{ref}} \cdot (T_i - T_{ref}) - \alpha_T \cdot (T - T_{ref})}{1 + \alpha_{T_{ref}} \cdot (T_i - T_{ref})}$$ [Math. 15]

With, $\alpha$ [Math. 16]

: technical linear expansion coefficient, it depends on the temperature.

$T_{ref}$ [Math. 17]

: measurement temperature for the measurement of $\alpha$ [Math. 18]

( $\alpha_{T_{ref}}$ [Math. 19]

is the value of $\alpha$ [Math. 20]

at $T_{ref}$ [Math. 21]

).

$T_i$ [Math. 22]

: test start temperature.

T [Math. 23]

: temperature considered at the instant t [Math. 24]

( $\alpha_T$ [Math. 25]

is the value of $\alpha$ [Math. 26]

at

T [Math. 27]

).

Thus, knowing $\varepsilon_{pl}$ [Math. 28]

(curve C5) and the stress (curve C4), the stress is integrated according to $\varepsilon_{pl}$ [Math. 29]

to obtain a curve C6 representing, as a function of temperature, the plastic deformation energy Epl [Math. 30]

accumulated by the same type of calculation as in the 1$^{st}$ embodiment, according to the following formula:

$$E_{pl} = \sum_{i,j} \int_0^{\varepsilon_{pij}^f} \sigma_{ij} \cdot d\varepsilon_{pij}$$ [Math. 31]

Thus, for each test piece, the curves are used to calculate a critical "thermomechanical path" beyond which the alloy recrystallizes.

Figure 4B:
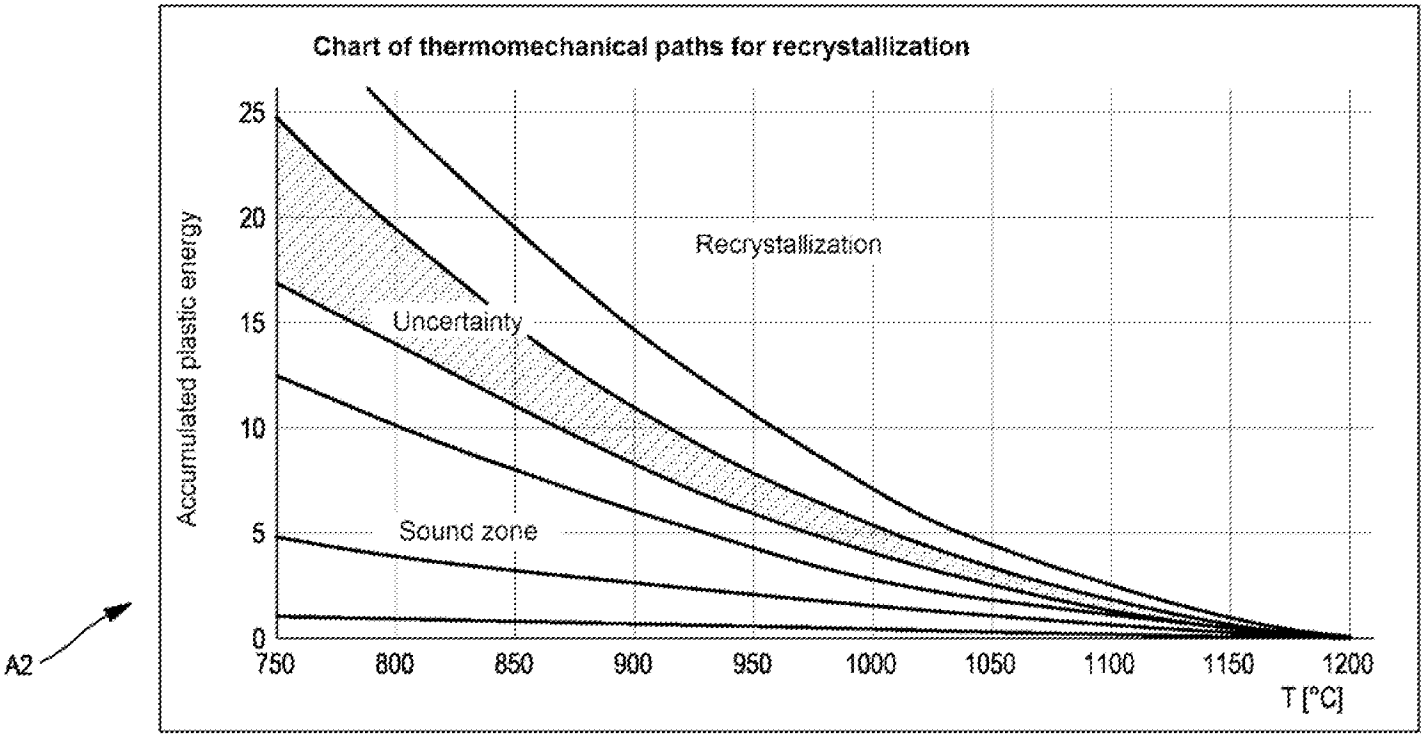
FIG. 4B illustrates a recrystallized grain prediction chart obtained according to the second embodiment of the invention.

With reference to FIG. 4B, a chart A2 is shown. The latter allows to determine plastic energy threshold values for the appearance of recrystallized grains.

Chart A2 consists of three zones, the range extent of which depends on the temperature during the test.

From the visualization of the three zones of the chart and digital simulation calculations, it is possible to determine the zones of the workpiece that will be most likely to recrystallize.

A chart allows to specify the range of recrystallization and thus to establish a critical path of risk of appearance of recrystallized grains.

Each curve represents a traction test. The green curves correspond to the sound test pieces and the red curves correspond to the test pieces having recrystallized.

Unlike the first embodiment P1, anisothermal tests are carried out which thus represent entire curves on a chart (Plastic energy; Temperature) and not points as is the case with isothermal tests.

The method presented here relates to anisothermal tests where the deformation is imposed at the same time as a cooling. This type of test is more representative of a method where the deformation takes place while the workpieces are cooling. These tests also allow to characterize a curve of a chart (Temperature; Variable studied). Advantageously, a single test thus allows to cover the entire cooling temperature range. The difference between the tests lies in the choice of different thermomechanical paths (cooling rate/deformation rate pair).

Preferably, the deformation rate is comprised between around $10^{-6}$/s and around $10^{-4}$/s (in % of deformation), and the cooling rate is around 10° C./min and around 40° C./min. Preferably, the deformation rate is around $10^{-5}$/s (in % of deformation), and the cooling rate is around 20° C./min.

The first embodiment is based on interrupted isothermal traction tests. Such tests allow to characterize a point of a chart (Temperature; Variable studied). It is therefore necessary to carry out several tests at a given temperature, for each temperature.

Since it is more representative of the method, the chart established on the basis of anisothermal tests allows to validate (or not) the old chart on the basis of isothermal tests, which is easier to obtain but less representative of the thermomechanics of the method.

Indeed, in the second embodiment P2, a difficulty consists in developing thermomechanical paths (cooling rate/deformation rate pair) characteristic of the method knowing that the test start temperature is less than the deformation start temperature in the method.

In addition, another difficulty consists in verifying that in the traction tests the desired cooling rate is reached (by the lamp furnaces of the fatigue machines).

Finally, an additional difficulty of the second embodiment P2 consists in being able to extract the plastic deformation from the total deformation value obtained experimentally.

In this case, it is necessary to take into account the thermal contraction of the traction test piece during the test (not taken into account by the machine). It is also necessary to take into account the fact that the properties of the material (which depend on the temperature, in particular the elastic limit) change during the test (unlike a test at imposed temperature where these properties remain constant).

Subsequently in a step E4, as in the first embodiment P1, a step of validating the chart previously determined can be carried out, by tests of casting simplified workpieces having a geometry significant of the geometry of the metal workpiece to be manufactured.

Thus, in this second embodiment, the casting/solidification parameters are also determined to better characterize the risk of appearance of recrystallized grains. Casting and solidification parameters are for example:

the susceptor setpoint temperature;

the speed of pulling the shell mold from the hot zone to the cold zone of the metal alloy melting furnace;

the use (or not) of a thermal insulator around the casting mold; and the thickness of the shell mold.

For a fixed simplified workpiece geometry, different castings of simplified workpieces can therefore be carried out, wherein the casting/solidification parameters can vary.

The simplified workpieces then undergo a thermal treatment, then a macrographic etching, like traction test pieces, to observe the appearance (or absence) of recrystallized grains in the simplified blade.

The plastic deformation energy is also calculated in the simplified workpieces during their cooling, by digital simulation of the casting of these workpieces (because it is inaccessible experimentally) to determine the plastic energy values reached in different zones of the workpiece during cooling. The influence of each casting/solidification parameter on the recrystallization being previously determined, it is therefore possible to corroborate the influence of the plastic energy values reached in the different zones of the workpiece during cooling with the presence of the recrystallization phenomenon in said zones of the workpiece.

The values obtained by simulations are thus plotted on the chart and by comparison with the observation of recrystallized grains obtained, it is possible to confirm and/or refine the plastic energy threshold values of the chart beyond which the alloy recrystallizes.

Thus, after establishing a chart A2 on the critical plastic deformation as a function of the temperature, it is possible to verify quantitatively that the criterion is valid by coupling the casting of clusters of test pieces and the digital simulation of these test pieces.

The method described above in these different embodiments therefore allows to precisely characterize the possibility of the appearance of recrystallized grains according to the plastic energy values reached in the different zones of the workpiece during cooling.

This method finds particular application in the turbines of turbojet engines, in particular in HP mobiles, HP (single and two-bladed) distributors, HP rings, BP1 mobiles and mobiles of the other stages, flanges, etc., for example made of an AM1 alloy or in DS 200 or CMSX-4 alloy.

Thereafter, for the implementation of real blades, the casting of the metal alloy in the mold is implemented under casting and solidification conditions determined using the chart in order for the temperature and plastic deformation energy conditions undergone by said metal workpiece to be less than a given threshold for the risk of appearance of crystallized grains, given by the chart.

Such a method has the advantage of using the quantity corresponding to the plastic deformation energy, which allows to precisely describe the physical phenomenon of recrystallization. It is thus possible to produce metal workpieces offering very high mechanical performance at high temperature, and particularly adapted for the aeronautical field.

The invention claimed is:

1. A method for manufacturing a metal workpiece by casting a metal alloy in a mold, wherein prior to said casting, a chart is determined providing a risk of appearance of recrystallized grains during the casting and/or solidification of the metal workpiece, depending on temperature and plastic deformation energy conditions undergone by said metal workpiece, said chart being obtained by implementing the following steps:

mechanical test on a test piece so as to characterize a plastic deformation of said test piece according to different values of imposed stresses;

thermal treatment of said test piece, then macrographic etching to determine an appearance of recrystallized grains in the test piece; and calculation, according to stress values measured during the mechanical test, of a plastic deformation energy in the test piece, the plastic deformation energy being plotted as a function of the temperature during the mechanical test, with information relating to a presence of recrystallized grains, so as to constitute the chart;

the casting of the metal alloy in the mold is then carried out in order for the temperature and plastic deformation energy conditions undergone by said metal workpiece to be manufactured to be less than a given threshold for the risk of appearance of determined recrystallized grains according to the chart.

2. The method for manufacturing a metal workpiece according to claim 1, wherein the mechanical test on the test piece is a traction test interrupted before rupture.

3. The method for manufacturing a metal workpiece according to claim 1, wherein the mechanical test is carried out at an imposed temperature.

4. The method for manufacturing a metal workpiece according to claim 3, wherein the calculation of the plastic deformation energy is determined from a total plastic deformation undergone by the test piece during a traction test.

5. The method for manufacturing a metal workpiece according to claim 1, wherein the mechanical test is carried out at an imposed deformation rate and at an imposed cooling rate.

6. The method for manufacturing a metal workpiece according to claim 5, wherein the calculation of the plastic deformation energy is determined from a total plastic deformation undergone by the test piece during the mechanical test, said total plastic deformation being determined from elastic deformation, and thermal expansion, undergone by the test piece during the mechanical test.

7. The method for manufacturing a metal workpiece according to claim 5, wherein the deformation rate is comprised, in % of deformation, between around $10^{-6}$/s and around $10^{-4}$/s, and/or the cooling rate is comprised between around 10° C./min and around 40° C./min.

8. The method for manufacturing a metal workpiece according to claim 1, wherein production of a chart includes, after the calculation of the plastic deformation energy, a step of verifying said calculation by digital simulation of the mechanical test including the following sub-steps:

casting test of at least one simplified workpiece having a geometry representative of the geometry of the metal workpiece to be manufactured;

thermal treatment of said at least one simplified workpiece, then macrographic etching to determine the presence of recrystallized grains in the at least one simplified workpiece;

digital simulation of the casting of the at least one simplified workpiece and calculation of the plastic deformation energy in said at least one simplified workpiece during its cooling;

plotting of the calculated values of plastic deformation energy to the chart and validation of the chart if the presence of recrystallized grains in the at least one simplified workpiece is consistent with the risk of appearance of recrystallized grains determined by the chart.

9. The method for manufacturing a metal workpiece according to claim 8, wherein said metal workpiece is a turbine blade, and wherein the at least one simplified workpiece includes a geometry representative of the geometry of the turbine blade.

10. The method for manufacturing a metal workpiece according to claim 1, wherein casting and solidification conditions include the following parameters:

a susceptor setpoint temperature;

a rate of pulling the casting mold from a hot zone to a cold zone of a furnace; and a use of a thermal insulator around the mold.

11. The method for manufacturing a metal workpiece according to claim 1, wherein said metal workpiece is made of an AM1, DS200 or CMSX-4 alloy.

12. The method for manufacturing a metal workpiece according to claim 1, wherein the thermal treatment step is carried out at a temperature above 1200° C.

* * * * *